United States Patent [19]

Hopper

[11] Patent Number: 4,774,790

[45] **Date of Patent: * Oct. 4, 1988**

[54] APPARATUS FOR JOINING CURVILINEAR STRUCTURAL PANELS AND THE LIKE

[75] Inventor: Thomas P. Hopper, Concord, N.H.

[73] Assignee: Kalwall Corporation, Manchester, N.H.

[ * ] Notice: The portion of the term of this patent subsequent to Feb. 17, 2004 has been disclaimed.

[21] Appl. No.: 844,856

[22] Filed: Mar. 27, 1986

[51] Int. Cl.[4] ..... E04B 1/32

[52] U.S. Cl. ..... 52/86; 52/463

[58] Field of Search ..... 52/80, 81, 86, 463

[56] References Cited

U.S. PATENT DOCUMENTS

| | | | |
|---|---|---|---|
| 1,981,417 | 11/1934 | Kreutzer | 52/86 |
| 2,278,956 | 4/1942 | Wagner | 52/794 |
| 2,644,777 | 7/1953 | Havens | 52/80 |
| 2,985,881 | 5/1961 | Holland | 52/81 |
| 3,133,133 | 5/1964 | Fairbanks | 52/80 |
| 3,158,961 | 12/1964 | Hawkins | 52/467 |
| 3,435,574 | 4/1969 | Hallock | 52/466 |
| 3,916,589 | 11/1975 | Richter | 52/81 |
| 3,999,336 | 12/1976 | Bance | 52/463 |
| 4,023,317 | 5/1977 | Bettger | 52/463 |
| 4,114,330 | 9/1978 | Sukolies | 52/467 |
| 4,189,882 | 2/1980 | Harrison | 52/466 |
| 4,462,390 | 7/1984 | Holdridge | 52/80 |
| 4,642,949 | 2/1987 | Hopper | 52/80 |

FOREIGN PATENT DOCUMENTS

| | | | |
|---|---|---|---|
| 893858 | 10/1953 | Fed. Rep. of Germany | 52/463 |

*Primary Examiner*—Henry E. Raduazo

*Attorney, Agent, or Firm*—Rines and Rines Shapiro and Shapiro

[57] ABSTRACT

A clamping structure for joining a pair of panels along curved and other seams comprising longitudinally extending opposing clamping surfaces for receiving therebetween the abutting but spaced apart edges of the panels, and provided with marginal sealing strips compressible against the outer and inner panel sheets along and overlapping the abutting panel edges, sealing the space between the panel edges and rigidly joining the panel edges along the seams.

19 Claims, 4 Drawing Sheets

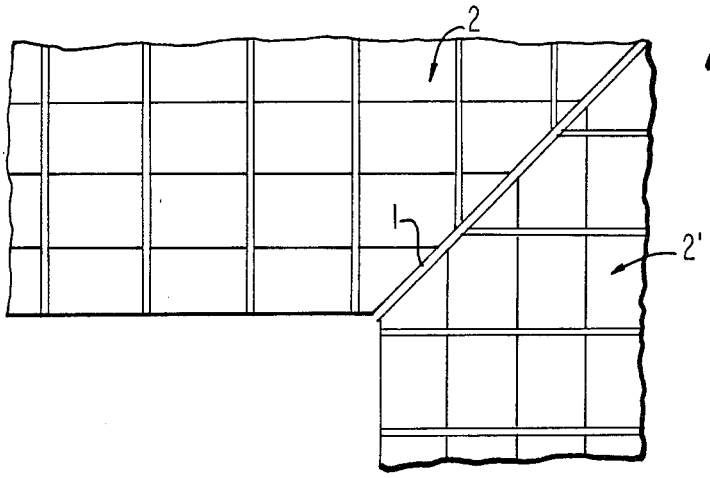
FIG. 2A.
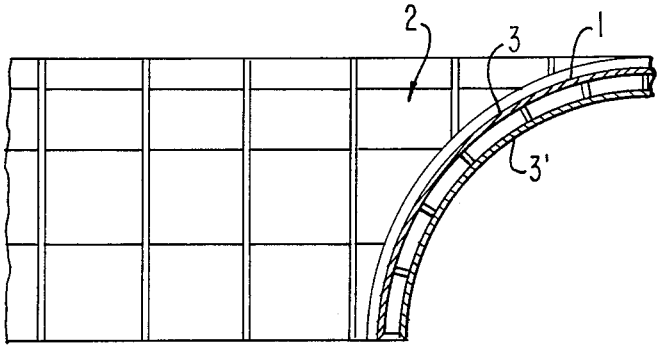
FIG. 2B.
FIG. 3.
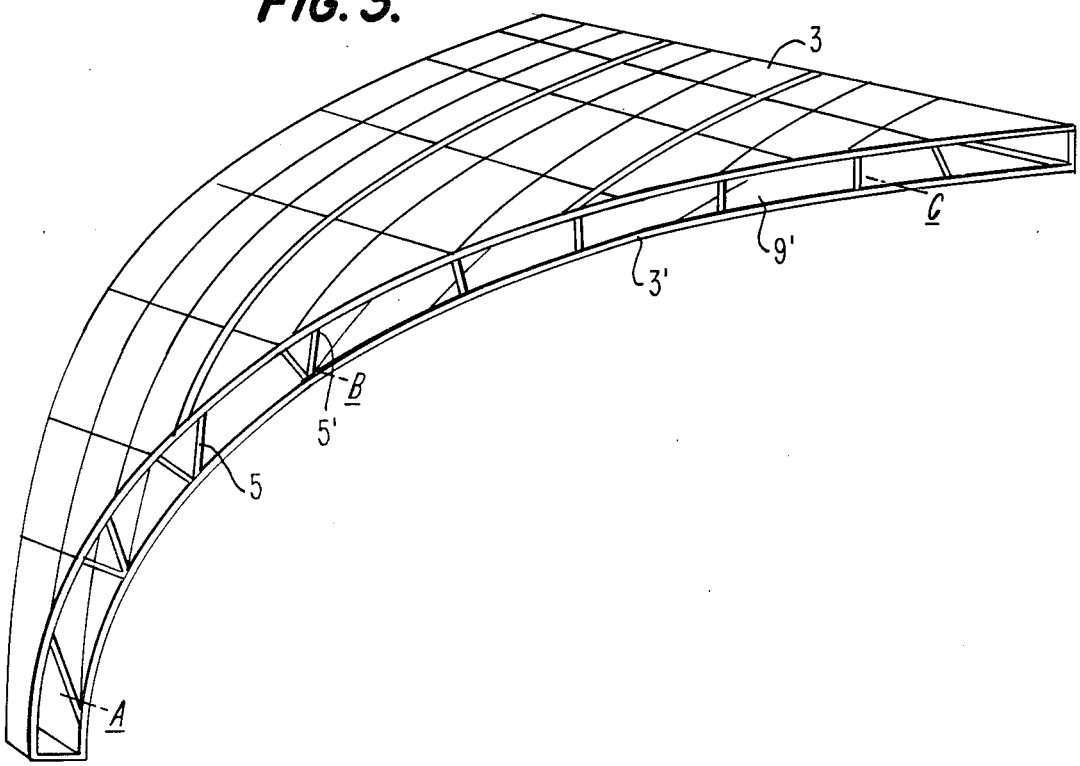

APPARATUS FOR JOINING CURVILINEAR STRUCTURAL PANELS AND THE LIKE

The present invention relates to apparatus for joining curvilinear structural panels and the like and, in particular, batten-like clamping mechanisms for permitting the ready joinder (and detachment) of abutting panels of the type having inner and outer cover sheets held spaced apart by longitudinally and transversely extending mullion and muntin interconnecting support members as described, for example, in U.S. Pat. No. 4,557,090—such panels often being of translucent cover sheet material, such as fiberglass and the like, to enable them to be light-transmitting and with the joinder preferably effected with a minimum width batten-like clamping structure.

In co-pending application, Ser. No. 844,838, filed of even date herewith, and entitled "Method of Joining Curvilinear Structural Insulating Panels and the Like and Improved Joined Panel Structure" (now U.S. Pat. No. 4,642,949,) there is disclosed a technique for appropriately cutting the edges of such panels for abutting the same usually with a slight gap or space therebetween in order to enable a batten-like joining structure to be applied that is adapted for joining such panels along seams that have no substantial straight portions, and, indeed, may have very complicated curves, as, for example, when vault roof constructions of different heights are to be joined, or special shaped arches or curved bends are required.

An object of the present invention, however, is to provide a novel apparatus for effecting such batten-like joinder of curvilinear panels and the like, prepared for such connection in accordance with the technique underlying said application and that can accommodate for such complicated (and, of course, simpler) joinder curves, bends or shapes, which include at least one straight line, but that, unlike the preferred mode of said application, enable the ready assembly of the panels (and disassembly if desired) in the field, as distinguished from permanent joinder in the factory.

A further object is to provide a novel batten-like clamping apparatus that is particularly adapted for the joining of such curvilinear structural insulating panels and the like.

Other and further objects will be described hereinafter and are more particularly delineated in the appended claims.

In summary, however, the invention embraces apparatus for joining a pair of curvilinear structural panels and the like, each having outer and inner parallel cover sheets held spaced apart by substantially longitudinally and transversely extending internal support members, the panels being transversely cut along the desired line of joinder and along substantially ellipsoidal cuts, at least in part, with the internal support members correspondingly cut along varying diagonal directions to the normal between the panel cover sheets, said apparatus having, in combination, a pair of opposing batten-like joinder clamping surfaces for receiving therebetween the cut edges of the pair of panels-to-be-joined, the panels being abutted with a small gap therebetween, and with said clamping surfaces overlapping the edges of the cut panel outer and inner cover sheets while extending longitudinally along said edges and said line, each clamping surface having resilient marginal strips extending along its inner edges for contacting the outer and inner panel cover sheets on either side of the panel edges and said line; and means for compressing the said surfaces toward one another effectively to connect the panel edges with a structurally rigid joint, and with said resilient marginal strips compressed to seal the joint and the said gap.

Preferred embodiments and best mode constructional details are now to be presented.

The invention will be described with reference to the accompanying drawing,

FIG. 1 of which is an isometric view illustrating a typical curvilinear panel seam or curved line of intended joinder between a pair of panels of the type described in the aforesaid patent; the architecture being illustrated as curved intersecting half-dome vaults;

FIGS. 2A and 2B are respectively plan and side views of the joined panels illustrated in FIG. 1;

FIGS. 1A through C are longitudinal fragmentary sections taken at the bottom region A, the intermediate region B and the top region C of the joinder seam of FIG. 1, and upon a somewhat enlarged scale;

FIG. 3 is a fragmentary isometric, longitudinally sectionalized, view illustrating the cut in accordance with the method of the said copending application which is effected in the pair of abutting panels-to-be-joined;

Figure 1:
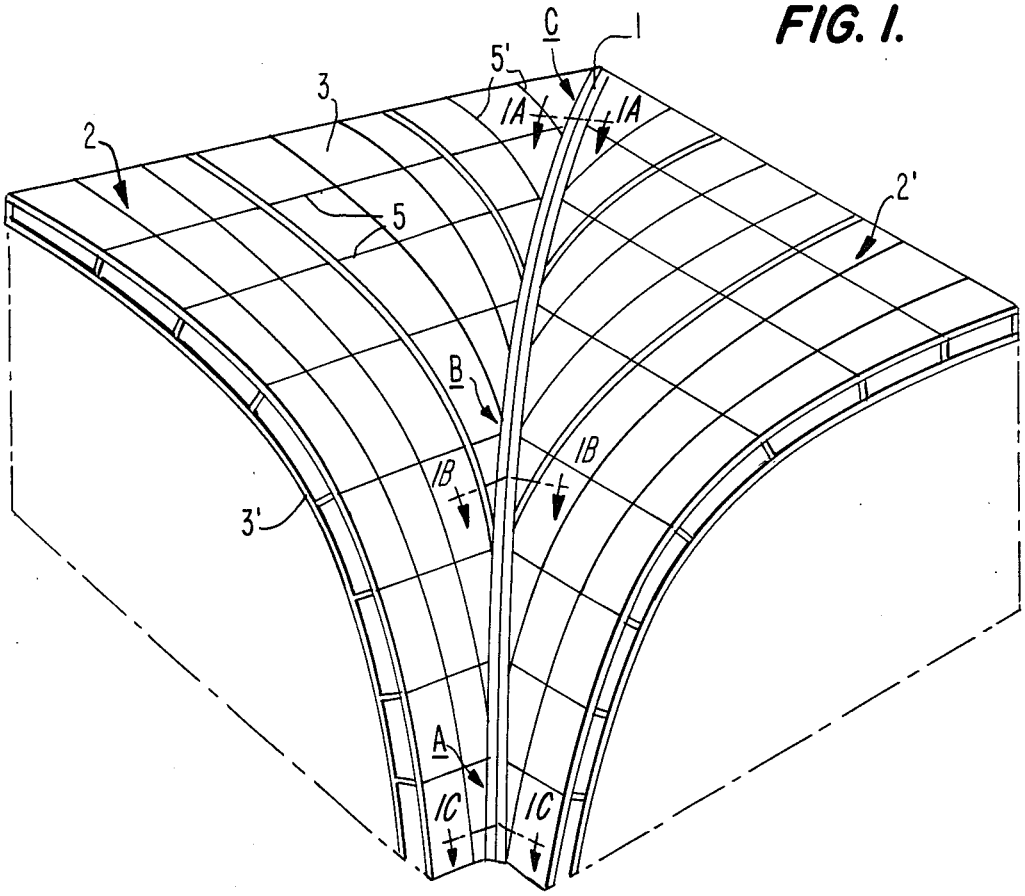

Referring to FIG. 1, as before stated, the present invention relates to providing for the joinder of intersecting curvilinear panels, such as the half-dome vaults 2 and 2', connected at the joining seam 1. As explained in said copending application, the preparing of the edges of the curvilinear panels for abutting and joining is not so simple as in the case of glass or plastic panels and the like which are readily joinable at bends or intersections by contact-abutting their normal cut edges and connecting with narrow batten strips of aluminum or other metal or the like. To the contrary, the curvilinear panels 2, 2' of the invention require different techniques in view of their relatively thick profile and complex structure, comprising outer and inner cover sheets 3 and 3', of fiberglass or the like, held parallelly coaxially extending in a spaced-apart relationship by longitudinally extending I-beams or mullion support members and interconnecting transverse rib munton support members, as described in said patent and as later described more fully herein, the glue lines to the panel cover sheets showing through at 5 and 5' respectively, in FIG. 1. The panels of this invention require, for such purposes, cuts that result in the outer and inner cover sheet edges defining substantially somewhat ellipsoidal cut patterns, with the ellipses for the outer and inner cover sheets being different, and the internal support members being correspondingly cut along generally diagonal directions to the normal between the panel cover sheets. The sheets may then be abutted but with a small gap or space therebetween, and the same closed over by applying clamping surfaces, later described, that overlap the edges of the abutting panels and provide weathersealing of the edges and gap, serving as a structurally rigid connecting batten-like structure. As previously stated, in accordance with the present invention, these clamping structures may be applied and removed in the field, so that the joined structural sections do not have to be prefabricated in the plant and shipped in joined fashion.

In FIG. 1, the outer and inner cover sheets 3 and 3' of each of the illustrative intersecting dome panel structures 2 and 2' are clamp-joined along the line of the desired seam 1, extending from the near bottom region A, curving upward through an intermediate region B and a near-top region C, along a curve having no straight portions, as is more clearly evident from the side view of Fg. 2B and plan of Fig. 2A. This and other complex curved-line junctures including straight line portions require the ability to effect joinders along curved portions of different and varying radii and shapes, necessitating the panel cuts of somewhat ellipsoidal configuration, more particularly shown in the upper and lower cut edges in FIG. 3 of the respective panel cover sheets 3 and 3' (the latter defining a somewhat different ellipsoid) and resulting in the internal I-beams 5 and connecting transverse mullion supports or ribs 5' generally being cut at varying diagonals with respect to the normal between the outer and inner panel cover sheets. As illustrated and as previously mentioned, the glue lines of the I-beam and transverse interconnecting supports show through translucent cover sheets 3 and 3', such as of fiberglass for its light-transmitting and thermal insulating properties; and, for aesthetic reasons, it is desired that the clamping structure simulate the conventional narrow batten strips used in other types of panel joints and the like to provide minimal interference with the light-transmitting surface.

Figure 4:
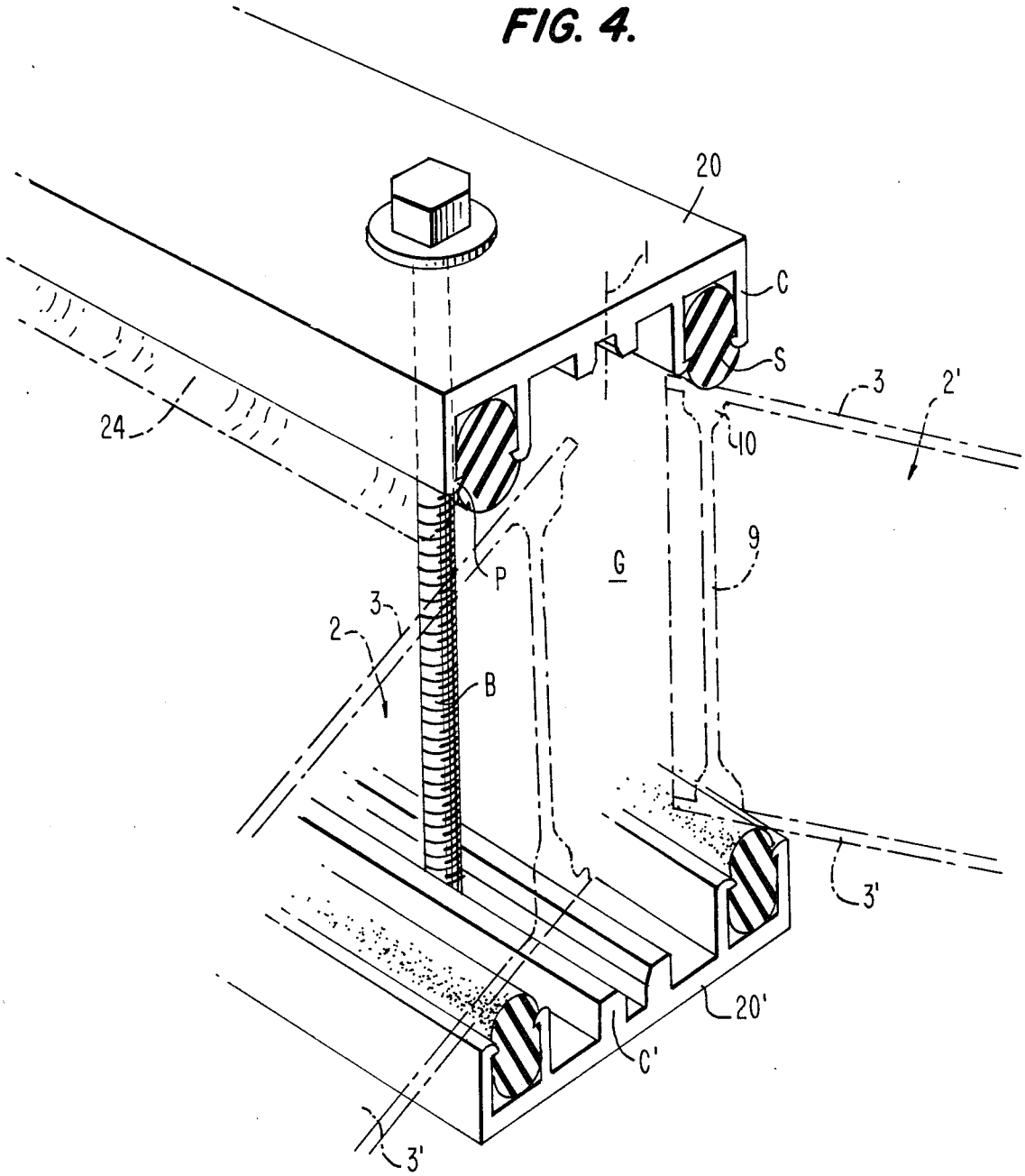
FIG. 4 is an isometric view upon an enlarged scale of the preferred batten-like joining clamping structure of the present invention, FIG. 5 being a detail of the locking at the bottom surface member thereof.

Referring to FIG. 4, the preferred clamping or joining structure of the invention is illustrated as comprising a pair of opposing clamping planar surface members 20 and 20' between which the abutting edges of the appropriately cut panels 2 and 2' are inserted—in this instance, convergingly toward the line 1 of desired juncture, with the cut edges of the adjacent panels spaced slightly by a gap G, and forming opposite acute angles between the clamping surfaces and the adjacent cover panel sheets. It is in this configuration that the clamp is to be applied to join the panels structurally rigidly and in a weatherproof fashion to enable the seal along the seal line 1. This is effected either by bending long longitudinally extending strips of the opposing clamping surfaces 20—20', or by securing successive adjacent sections of the same. The upper and lower clamping surface members 20 and 20' are each shown provided at their inner surfaces with channels C along the marginal edges thereof and carrying rubber-like or other resilient rods or sealing members S, preferably extending beyond the channels (as shown downwardly and upwardly from the respective supporting clamping suraces 20 and 20' in FIG. 4) so as to contact the outer and inner panel cover sheets 3 and 3' inward of the cut edges of the adjacent panels 2 and 2', overlapping the edges as shown. When the surfaces are compressed together, as by the threaded transversely extending screwbolt B, the resilient marginal seals S press against the panels and thereby effect joinder and weatherproof sealing along the seam line 1, with the space G closed and sealed off. As further taught in the aforesaid co-pending application, after the cutting of the edges of the panel, end walls 9, sealed as at 10, close off the interior of the panels before such joinder.

Figure 5:
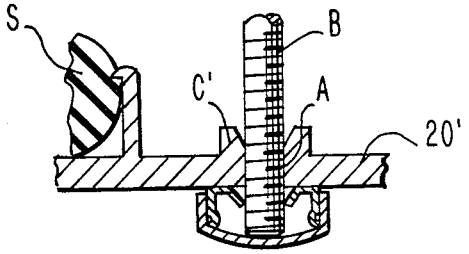

In the specific embodiment of FIG. 4, the outer downwardly extending edge walls of the channels C are provided with inward projections P that secure the resilient rubber-like sealing rod members S to hold them in place. The round cross-section of the members S particularly adapts to the varying angles of panel joinder along the desired line. The bolt B may be threaded into an aperture A in the lower surface clamping members 20', shown formed in a pair of interior smaller channels C' along the inner surface of the bottom supporting member 20', FIG. 5. In the example illustrated, the outer rounded edges of the rods S are well shaped and adapted for sealing along the channels on each side of the line 1, as at 24, to effect further weatherproofing insurance and/or structural support. This clamp construction, furthermore, results in an inherent adaptability to bending in the longitudinal direction along the line of joinder.

Figure 1A:
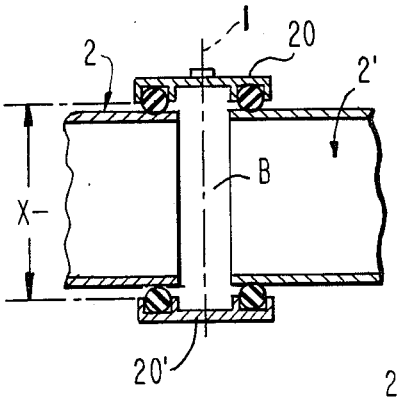
Figure 1B:
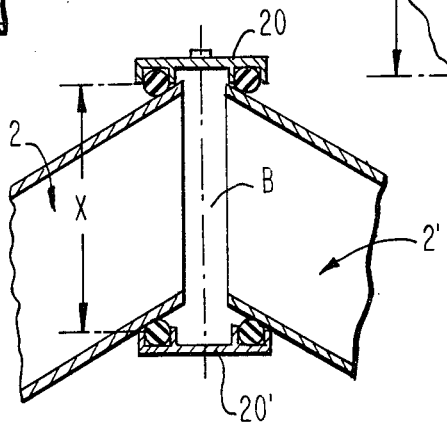
Figure 1C:
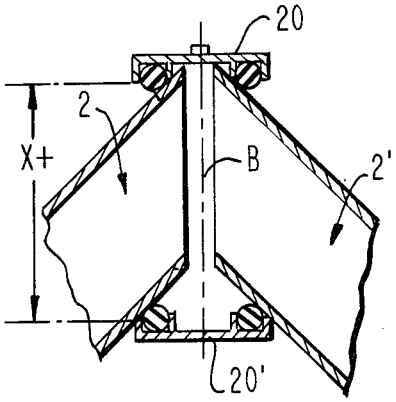

Turning to FIGS. 1A through 1C, the clamping members 20—20' are shown assembled at the respective lower, middle and upper regions A, B and C, before discussed. It will be evident from the complex nature of the curve 1 that the actual dimension between the compressed clamped members 20 and 20' is largest (x+) in the region of FIG. 1C, less (x) in the intermediate region B, and smallest (x−) in the region of FIG. 1A, these variations being readily accommodated by the clamping joinder construction of the present invention. As will be appreciated from the foregoing figures, the angles of panel joinder vary from about 90° in the region of FIG. 1C to about 180° in the region of FIG. 1A.

Figure 6:
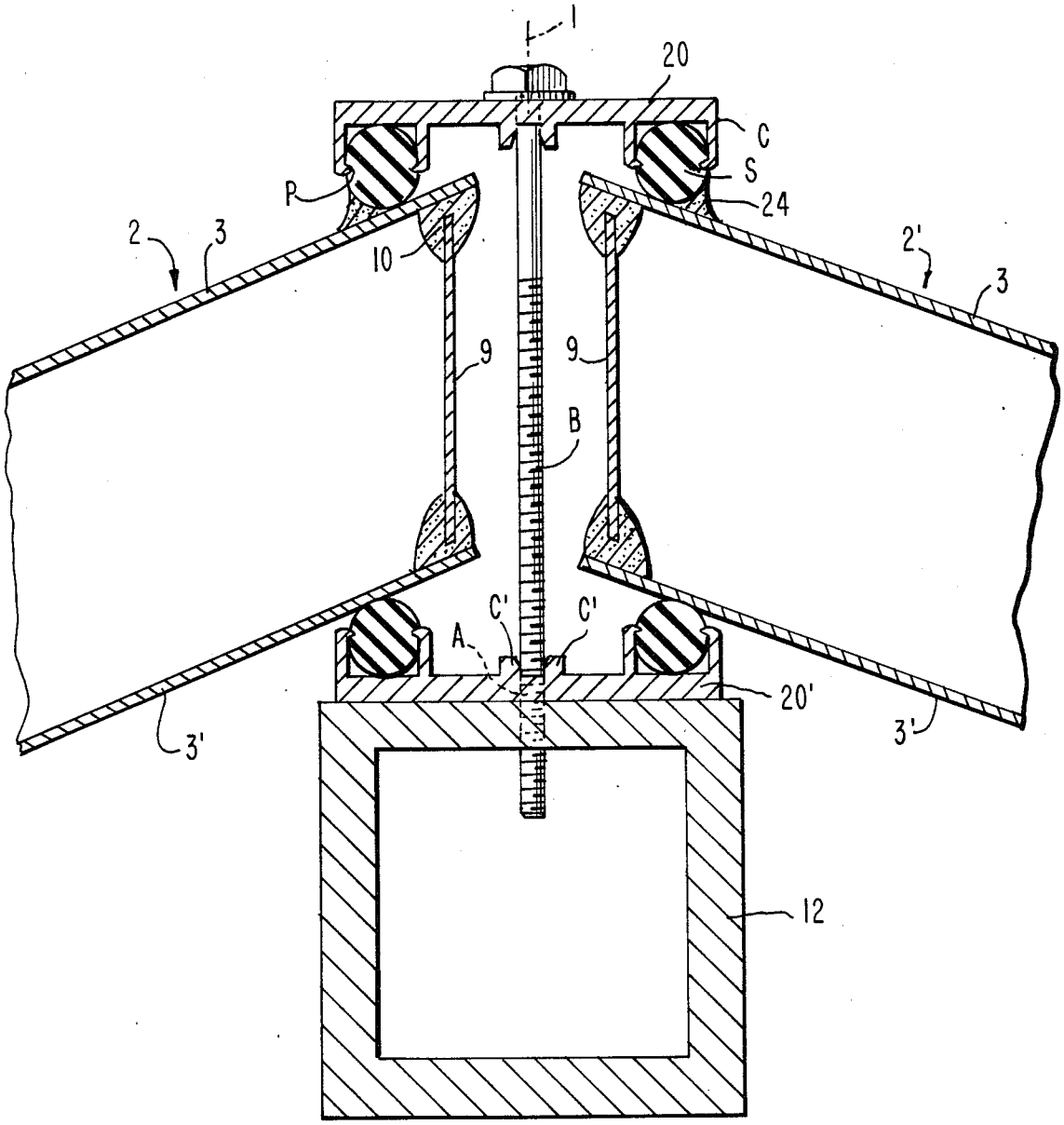
FIG. 6 is a sectional view of a modification employing a reinforcing rod or tube.

If desired, moreover, as more particularly shown in FIG. 6, a further supporting or reinforcing tube or other member 12 may extend along the line 1 (shown inwardly of the joint), as by connecting this same to the outer surface of the bottom clamping surface member 20'.

Other types of compressing or locking mechanisms may, of course, be utilized, as may other modifications apparent to those skilled in the art, and such are considered to fall within the spirit and scope of the invention as defined in the appended claims.

I claim:

1. Joint apparatus comprising a pair of curvilinear structural panels each having parallel outer and inner cover sheets held spaced apart by longitudinally and transversely extending internal support members, the panels being transversely cut to conform with a desired line of joinder and along substantially ellipsoidal cuts, with internal support members of the panel being correspondingly cut along generally diagonal directions to the normal between the panel cover sheets, the cut edges of the panels being abutted with a small gap therebetween along said line of joinder and with the panels coming together at angles of joinder which vary substantially along said line as viewd in planes perpendicular to said line, and clamping means joining the panels to one another, the clamping means including a pair of battenlike clamping members extending longitudinally along said line and receiving the abutted edges of the panels therebetween and means urging the clamping members together, each clamping member having at opposite longitudinal inner edges thereof resilient sealing strips extending along those inner edges, with the sealing strips of the respective clamping members being compressed under force exerted by said urging means against the inner panel cover sheets and the outer panel cover sheets, respectively, on either side of the panel edges and said line, the shape of the sealing strips adapting to the varying angles of joinder of the panels such that the sealing strips seal against the outer and inner panel cover sheets longitudinally along said line of joinder, whereby the panels are connected by a structurally rigid, sealed joint.

2. Apparatus as claimed in claim 1 and in which said strips are rubber-like resilient rods of round cross-section held along the inner edges of the clamping members within channels and extending beyond said channels toward the panel cover sheets.

3. Apparatus as claimed in claim 2 and in which the urging means comprises threaded bolt means extending from one clamping member transversely through said gap and locking in aperture means disposed in the other clamping member.

4. Apparatus as claimed in claim 3 and in which said aperture means comprises a hole into which the threads of the bolt means may secure and which is formed in channel means disposed interiorly of and along said other clamping member.

5. Apparatus as claimed in claim 2 and in which said channels have outer walls extending inwardly toward the panel cover sheets, said outer walls having inner edges provided with projections holding said resilient rods within said channels and outer edges covered with sealant so as to insure weather stripping along the joined panel cover sheets on each side of the clamping surfaces.

6. Apparatus as claimed in claim 1 and in which said clamping members form opposite acute angles with the panel cover sheets.

7. Apparatus as claimed in claim 1 and in which said urging means is releasable to permit disassembly of the joined panels.

8. Apparatus as claimed in claim 1 and in which said angles of joinder include angles ranging from a small obtuse angle to a large obtuse angle.

9. A batten-like clamp for joining two curvilinear panels provided with parallel outer and inner cover sheets and respective edges which may be abutted with a slight gap therebetween along a curved line of joinder with the panels coming together at angles of joinder which vary substantially along said line as viewed in planes perpendicular to said line, the clamp having, in combination, a pair of opposed longitudinally extending clamping surface members between which the edges of the two panels are to be received in abutting relationship as aforesaid, each clamping surface member having opposite longitudinal margins each with a longitudinal channel having sidewalls defined by a pair of laterally spaced walls projecting toward the opposed clamping surface member, each channel having a rubber-like resilient sealing rod of round cross-section fitted therein and retainably held therein by means of the corresponding sidewalls, and threaded bolt means extending between the clamping surface members for urging the clamping surface members toward one another, the respective sealing rods having portions of their round cross-sections projecting from said channels and disposed such that when urged together under a compressive force exerted by said bolt means, said projecting portions will adapt to the varying angles of joinder of the received panels and compressively seal against the outer and inner panel cover sheets longitudinally along the abutted panel edges, on either side of said line of joinder.

10. A clamp as claimed in claim 9 and in which said resilient sealing rods will adapt to varying angles of joinder which include angles ranging from a small obtuse angle to a large obtuse angle.

11. A clamp as claimed in claim 9 and in which an outer wall of each channel has an inner edge with a projection which engages and retains the corresponding sealing rod within that channel.

12. Joint apparatus comprising a pair of curvilinear structural panels with edges abutted with a small gap therebetween along a curved line of joinder, said panels coming together at angles of joinder which vary substantially along said line as viewed in planes perpendicular to said line, and clamping means joining said panels to one another and including a pair of continuous batten-like clamping members extending longitudinally along said line of joinder and receiving the abutted edges of said panels therebetween and means urging said clamping members together, each clamping member having at opposite longitudinal inner edges thereof resilient sealing strips extending along said inner edges, the sealing strips of the respective clamping members being compressed under force exerted by said urging means against opposite sides of the abutted panels, respectively, on either side of said line of joinder, the shape of the sealing strips adapting to the varying angles of joinder of said panels such that the sealing strips seal against said opposite sides of the abutted panels longitudinally along said line of joinder.

13. Apparatus as claimed in claim 12 and in which the angles of joinder of said panels vary from about 90° to about 180°.

14. Apparatus as claimed in claim 12 and in which said strips are rubber-like resilient members having portions of rounded cross-section compressively sealed against said panels.

15. Apparatus as claimed in claim 14 and in which said strips have portions held within channels extending along the longitudinal inner edges of said clamping members.

16. Apparatus as claimed in claim 15 and in which said channels have respective walls extending inwardly toward said panels, said walls having inner edges provided with projections holding the second-mentioned portions of said strips within said channels.

17. Joint apparatus comprising a pair of curvilinear structural panels with continuously curved edge portions abutted with a small gap therebetween along a curved line of joinder, said panels coming together at angles of joinder which vary substantially along said line as viewed in planes perpendicular to said line, and clamping means joining said panels to one another and including a pair of batten-like clamping members extending longitudinally along said line of joinder and receiving the abutted edge portions of said panels therebetween and means urging said clamping members together, each clamping member having at opposite longitudinal inner edges thereof resilient sealing strips extending along said inner edges, the sealing strips of the respective clamping members being compressed under force exerted by said urging means against opposite sides of the abutted panels, respectively, on either side of said line of joinder, the shape of the sealing strips adapting to the varying angles of joinder of said panels such that the sealing strips seal against said opposite sides of the abutted panels longitudinally along said line of joinder.

18. Apparatus as claimed in claim 17 and in which said strips are rubber-like resilient members having portions of rounded cross-section compressively sealed against said panels.

19. Apparatus as claimed in claim 17 and in which said angles of joinder include angles ranging from a small obtuse angle to a large obtuse angle.

* * * * *